US007348941B2

(12) United States Patent
Chen et al.

(10) Patent No.: US 7,348,941 B2
(45) Date of Patent: Mar. 25, 2008

(54) DRIVING CIRCUIT OF PLASMA DISPLAY PANEL

(75) Inventors: Bi-Hsien Chen, Ping-Tung Hsien (TW); Yi-Min Huang, Taipei (TW)

(73) Assignee: Chunghwa Picture Tubes, Ltd., Taipei (TW)

( * ) Notice: Subject to any disclaimer, the term of this patent is extended or adjusted under 35 U.S.C. 154(b) by 149 days.

(21) Appl. No.: 11/424,229

(22) Filed: Jun. 14, 2006

(65) Prior Publication Data

US 2006/0290631 A1 Dec. 28, 2006

Related U.S. Application Data

(60) Provisional application No. 60/595,300, filed on Jun. 22, 2005.

(51) Int. Cl.
*G09G 3/28* (2006.01)

(52) U.S. Cl. ..... 345/66; 345/63

(58) Field of Classification Search ..... 345/37, 345/41, 42, 60, 63, 66; 315/169.3, 169.4; 313/567

See application file for complete search history.

(56) References Cited

U.S. PATENT DOCUMENTS 5,670,974 A 9/1997 Ohba et al.
6,628,275 B2 * 9/2003 Vossen et al. ..... 345/211
6,680,581 B2 * 1/2004 Lee et al. ..... 315/169.3
6,768,270 B2 * 7/2004 Chae ..... 315/169.3
6,781,322 B2 * 8/2004 Onozawa et al. ..... 315/169.3
6,933,679 B2 * 8/2005 Lee et al. ..... 315/169.4
6,961,031 B2 * 11/2005 Lee et al. ..... 345/60
7,023,139 B2 * 4/2006 Lee et al. ..... 315/169.1
7,027,010 B2 * 4/2006 Lee ..... 345/60
7,123,219 B2 * 10/2006 Lee ..... 345/76
7,176,854 B2 * 2/2007 Lee et al. ..... 345/60
2003/0173905 A1 * 9/2003 Lee et al. ..... 315/169.3
2003/0193454 A1 * 10/2003 Lee et al. ..... 345/63
2004/0012546 A1 * 1/2004 Takagi et al. ..... 345/60
2004/0135746 A1 * 7/2004 Lee et al. ..... 345/60
2006/0238447 A1 * 10/2006 Chen ..... 345/60
2006/0267874 A1 * 11/2006 Chen et al. ..... 345/68

* cited by examiner

*Primary Examiner*—Ricardo Osorio
(74) *Attorney, Agent, or Firm*—Winston Hsu

(57) ABSTRACT

A driving circuit for creating sustain waveforms of plasma display panel (PDP) is provided. The driving circuit includes the functions of voltage clamping and energy recovery. The main structure of this driving circuit is composed of 5 switches, two diodes, and an inductor which couple to the panel capacitor of the PDP. The use of more voltage potentials can also be implemented very easily if they are required.

15 Claims, 8 Drawing Sheets

DRIVING CIRCUIT OF PLASMA DISPLAY PANEL

CROSS REFERENCE TO RELATED APPLICATIONS

This application claims the benefit of the filing date of U.S. provisional patent application No. 60/595,300, filed Jun. 22, 2005, the contents of which are hereby incorporated by reference.

BACKGROUND OF THE INVENTION

1. Field of the Invention

The present invention relates to a driving circuit, and more specifically, to a driving circuit for a plasma display panel (PDP).

2. Description of the Prior Art

In a plasma display panel (PDP), charges are accumulated in cells according to display data, and a sustaining discharge pulse is applied to paired electrodes of the cells in order to initiate discharge glow to effect display. As far as the PDP display is concerned, a high voltage is required to be applied to the electrodes, and a pulse-duration of several microseconds is usually required. Hence the power consumption of a PDP display is considerable. Energy recovering (power saving) is therefore important. Many designs and patents have been developed for providing methods and apparatuses for energy recovery in PDPs.

Please refer to FIG. 1 which illustrates a circuit diagram of a PDP driving circuit 100 according to the prior art. The PDP driving circuit 100 comprises an equivalent panel capacitor Cp having an X side and a Y side, four switches S1 to S4 for permitting current to pass as part of a voltage clamp circuit, and a charging/discharging circuit that includes two switches S5 and S6 with body diodes, two diodes D1 and D2, and an inductor L1. The PDP driving circuit 100 requires the two switches S5 and S6 in order to allow two-direction discharge, which is required for energy recovery. That is, the two switches S5 and S6 achieve two paths that allow ineffective power from the X side of the panel capacitor Cp to be recovered to the Y side and vice versa.

In operation, the switches S1 to S6 are controlled to provide panel capacitor Cp voltages as shown in FIG. 2. In plot 204, the individual voltages of the X side (dashed line) and Y side (solid line) of the panel capacitor Cp are shown to vary between 0 and Vs. Plot 202 shows the voltage across the panel capacitor Cp, which is the voltage of the Y side minus the voltage of the X side. The voltage across the panel capacitor Cp varies between Vs and −Vs.

The prior art requires six switches S1 to S6, thereby increasing the space required on a semiconductor integrated circuit.

SUMMARY OF THE INVENTION

It is therefore an objective of the invention to provide a plasma display panel driving circuit that solves the problems of the prior art.

Briefly summarized, the claimed plasma display panel driving circuit includes a panel capacitor having a first side and a second side, a first switch electrically connected between the first side of the panel capacitor and a first voltage, a second switch electrically connected between the second side of the panel capacitor and the first voltage, a third switch having a first end coupled to the first side of the panel capacitor and a second end, a fourth switch having a first end coupled to the second side of the panel capacitor and a second end, an inductor electrically connected between a second end of the third switch and a second end of the fourth switch, a first diode having a first end coupled to the second end of the third switch and a second end, a second diode having a first end coupled to the second end of the fourth switch and a second end coupled to a second end of the first diode, and a fifth switch electrically connected between a second voltage and the second end of the first diode.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
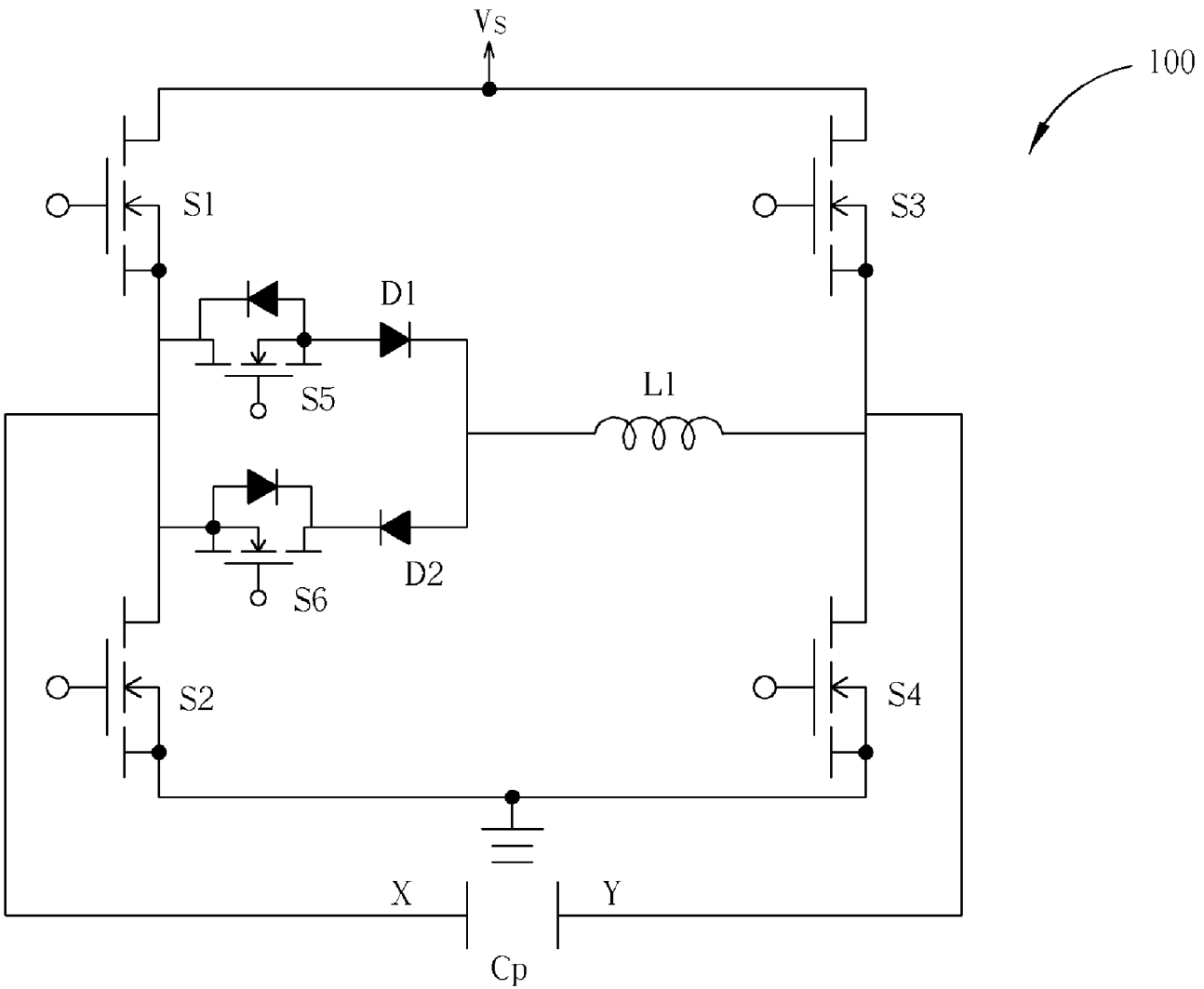
Fig. 1 Prior Art
FIG. 1 is a circuit diagram of a plasma display panel driving circuit according to the prior art.
Figure 2:
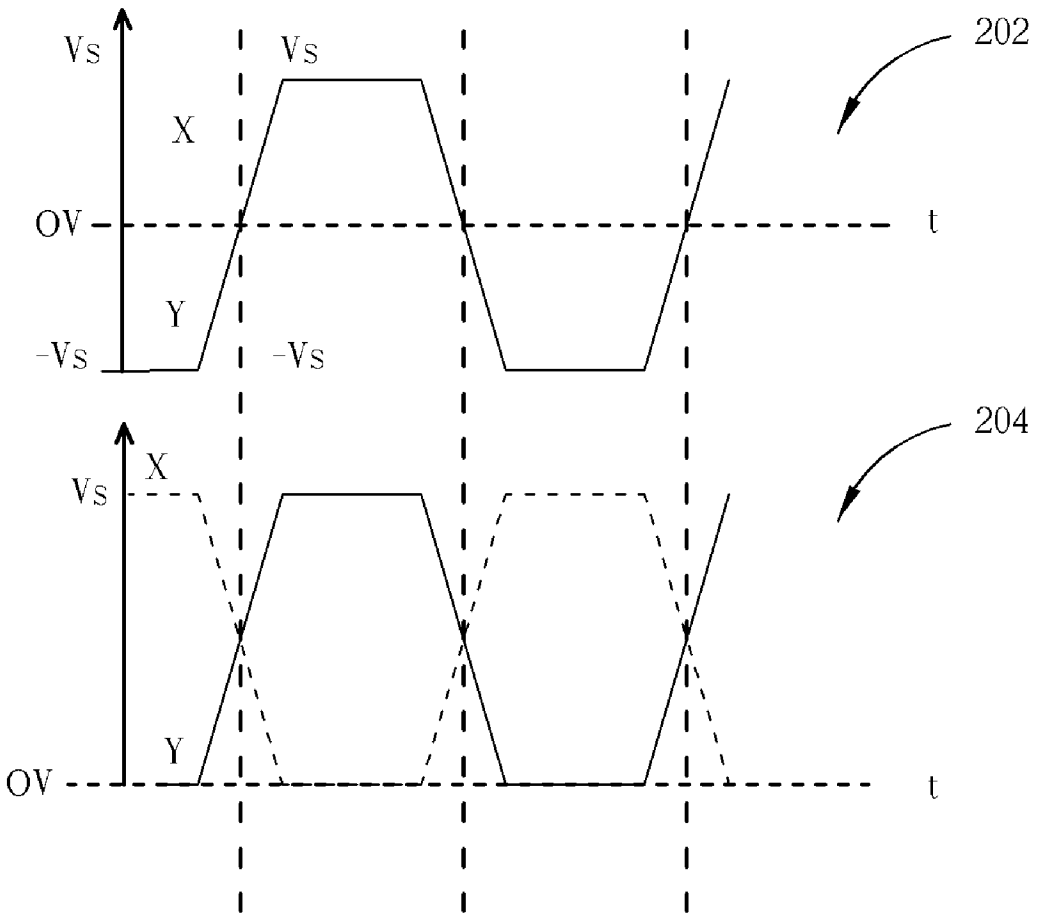
Fig. 2 Prior Art
FIG. 2 shows voltage levels in the circuit of FIG. 1.
Figure 3:
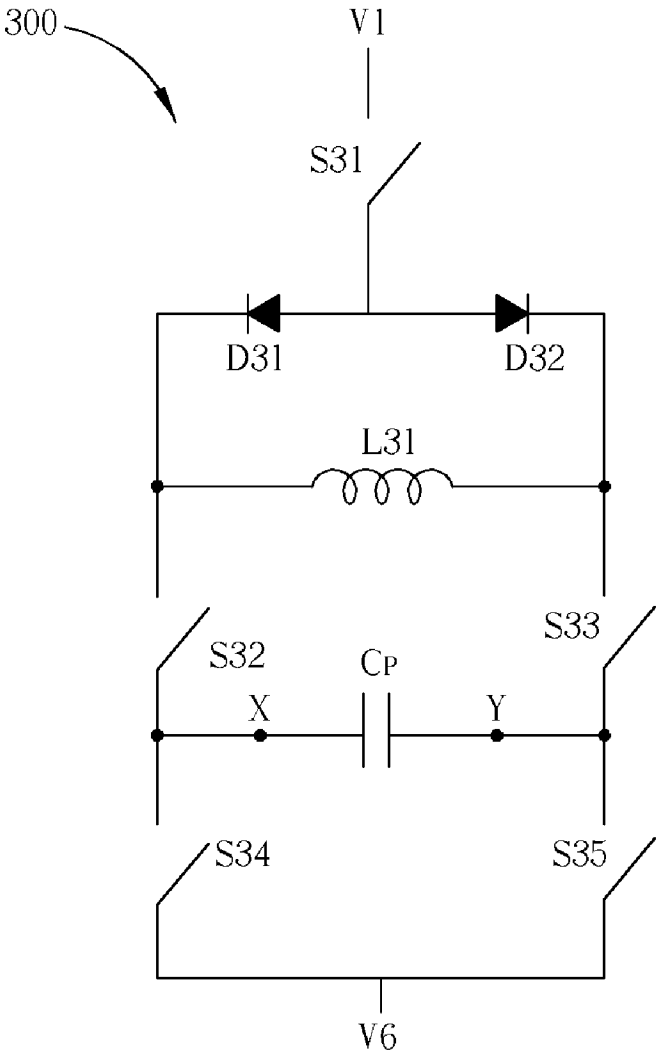
FIG. 3 is a circuit diagram of a plasma display panel driving circuit according to a first embodiment of the present invention.

The present invention provides a new driving circuit for the PDP. Please refer to FIG. 3. FIG. 3 is a circuit diagram of a plasma display panel driving circuit 300 according to a first embodiment of the present invention. The driving circuit 300 comprises five switches S31, S32, S33, S34, and S35, two diodes D31 and D32, and an inductor L31, coupled to an equivalent panel capacitor $C_p$ of a plasma display panel. The driving circuit 300 is electrically connected to a voltage source V1, wherein the voltage potential output by voltage source V1 is greater than the voltage potential output by voltage source V6. The voltage V1 is a voltage, whereas the voltage V6 can be ground or a negative voltage.

The switch S31 is electrically connected at one end to the voltage source V1 and is electrically connected at the other end to anodes of diodes D31 and D32. The inductor L31 is electrically connected between cathodes of diodes D31 and D32. The switch S32 is electrically connected between the cathode of diode D31 and an X side of the panel capacitor $C_p$, whereas the switch S33 is electrically connected between the cathode of diode D32 and a Y side of the panel capacitor $C_p$. The switch S34 is electrically connected between the X side of the panel capacitor $C_p$ and voltage source V6, and the switch S35 is electrically connected between the Y side of the panel capacitor $C_p$ and voltage source V6. The switches S31 to S35 can be N-type or P-type metal oxide semiconductor (MOS) transistors, other types of transistors, or other switching devices.

Figure 4:
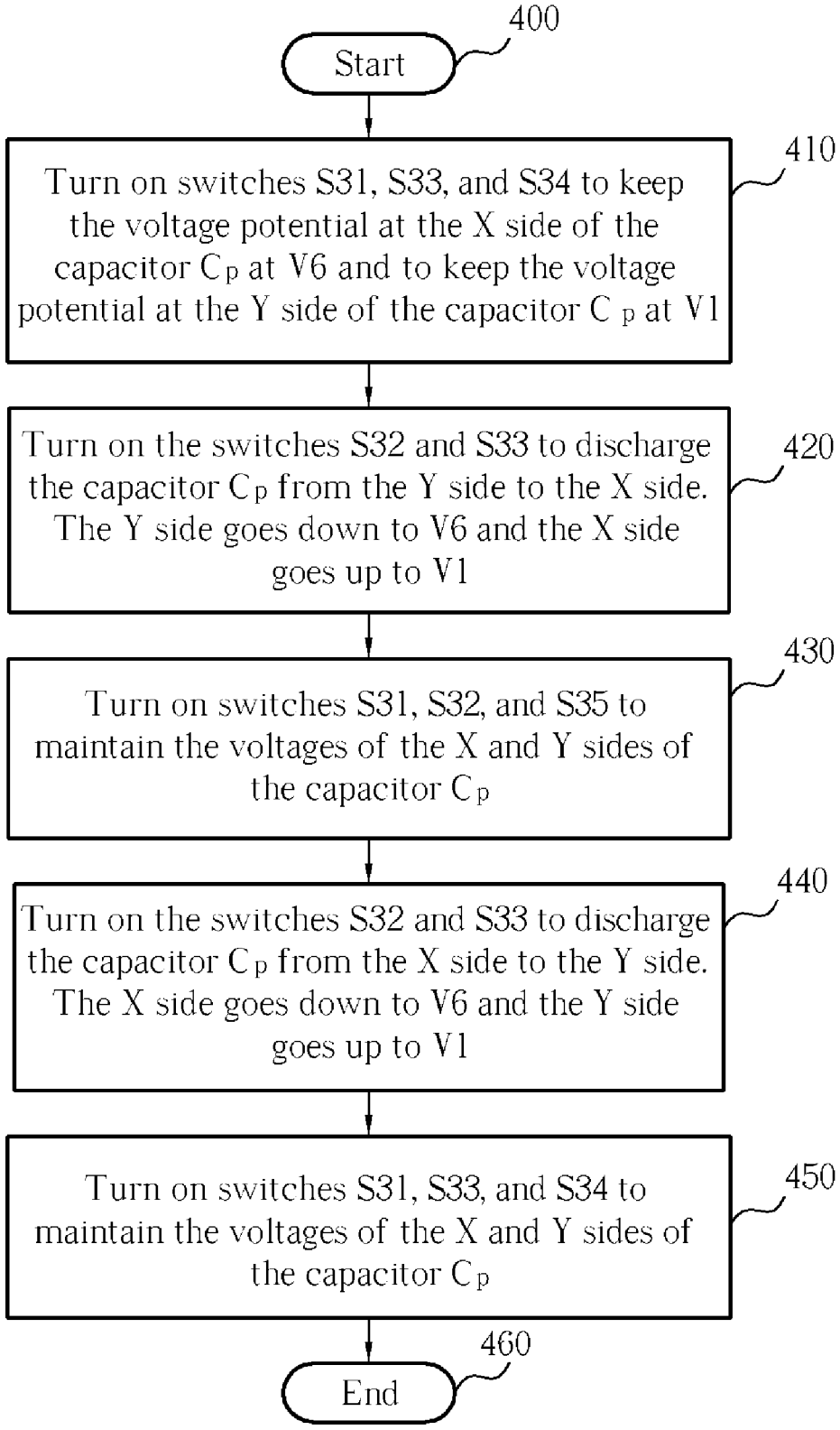
FIG. 4 is a flowchart illustrating the operation of the driving circuit of the first embodiment for creating a sustain waveform.

Please refer to FIG. 4, which illustrates the operation of the driving circuit 300 of the first embodiment for creating a sustain waveform. Steps contained in the flowchart will be explained as follows.

Step 400: Start.

Step 410: Keep the voltage potential at the X side of the panel capacitor $C_p$ at voltage source V6 by turning on the switch S34. Keep the voltage potential at the Y side of the panel capacitor $C_p$ at V1 by turning on the switches S31 and S33, where the current path is through S31, D32, and S33.

Step 420: Discharge the panel capacitor $C_p$ from the Y side to the X side by turning on the switches S32 and S33. The voltage potential at the X side of the panel capacitor $C_p$ goes up to V1 and the voltage potential at the Y side of the panel capacitor $C_p$ goes down to voltage source V6 accordingly, and the current path is through S33, L31, and S32.

Step 430: Keep the voltage potential at the X side of the panel capacitor $C_p$ at V1 by turning on the switches S31 and S32, where the current path is through S31, D31, and S32. Keep the voltage potential at the Y side of the panel capacitor $C_p$ at voltage source V6 by turning on the switch S35.

Step 440: Discharge the panel capacitor $C_p$ from the X side to the Y side by turning on the switches S32 and S33. The voltage potential at the X side of the panel capacitor $C_p$ goes down to voltage source V6 and the voltage potential at the Y side of the panel capacitor $C_p$ goes up to V1 accordingly, and the current path is through S32, L31, and S33.

Step 450: Keep the voltage potential at the X side of the panel capacitor $C_p$ at voltage source V6 by turning on the switch S34. Keep the voltage potential at the Y side of the panel capacitor $C_p$ at V1 by turning on the switches S31 and S33, where the current path is through S31, D32, and S33.

Step 460: End.

Figure 5:
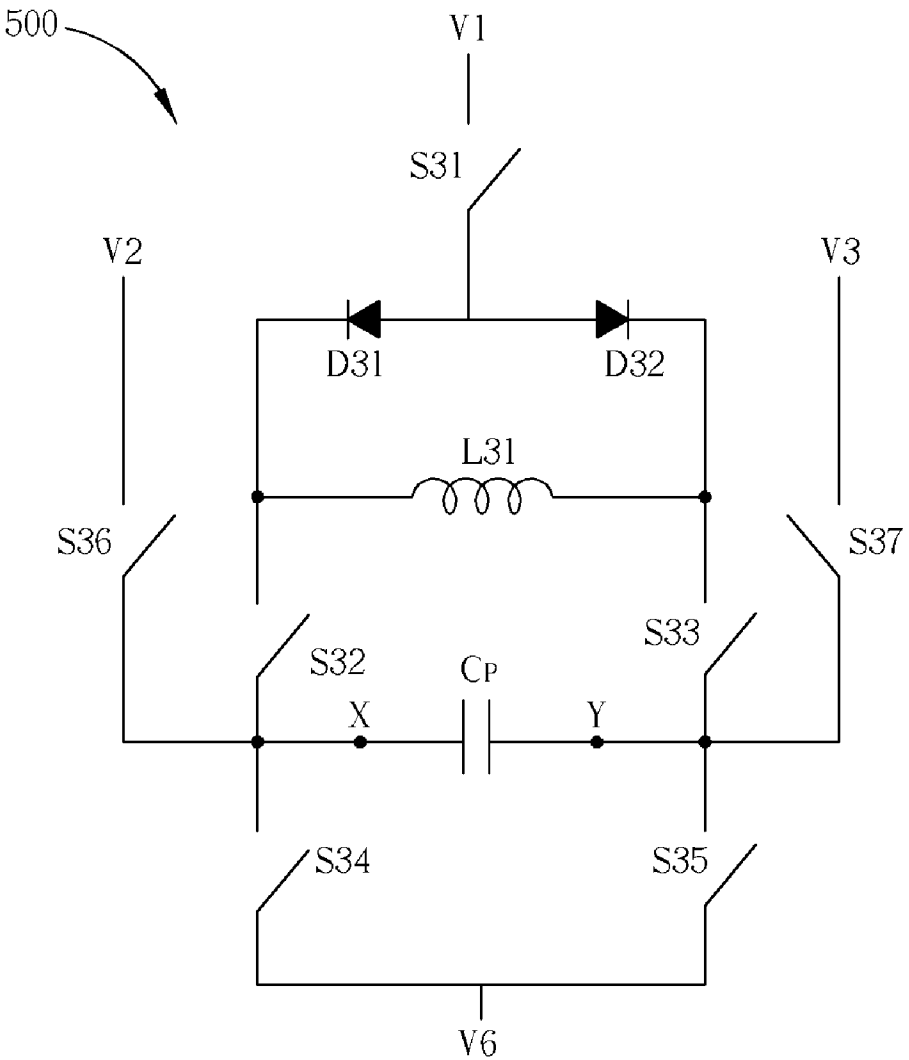
FIG. 5 is a circuit diagram of a plasma display panel driving circuit according to a second embodiment of the present invention.

Please refer to FIG. 5. FIG. 5 is a circuit diagram of a plasma display panel driving circuit 500 according to a second embodiment of the present invention. The driving circuit 500 is similar to the driving circuit 300 shown in FIG. 3, and also comprises the five switches S31, S32, S33, S34, and S35, two diodes D31 and D32, and the inductor L31 coupled to the equivalent panel capacitor $C_p$. The driving circuit 500 additionally includes switches S36 and S37 and voltage sources V2 and V3. Switch S36 is electrically connected between voltage source V2 and the X side of the panel capacitor $C_p$. Switch S37 is electrically connected between voltage source V3 and the Y side of the panel capacitor $C_p$. Voltage potentials output from voltage sources V2 and V3 are both greater than the voltage potential output from voltage source V1. The voltage potential output by voltage source V1 is greater than the voltage potential output by voltage source V6. The voltage V1 is a voltage, whereas the voltage V6 can be ground or a negative voltage.

Figure 6:
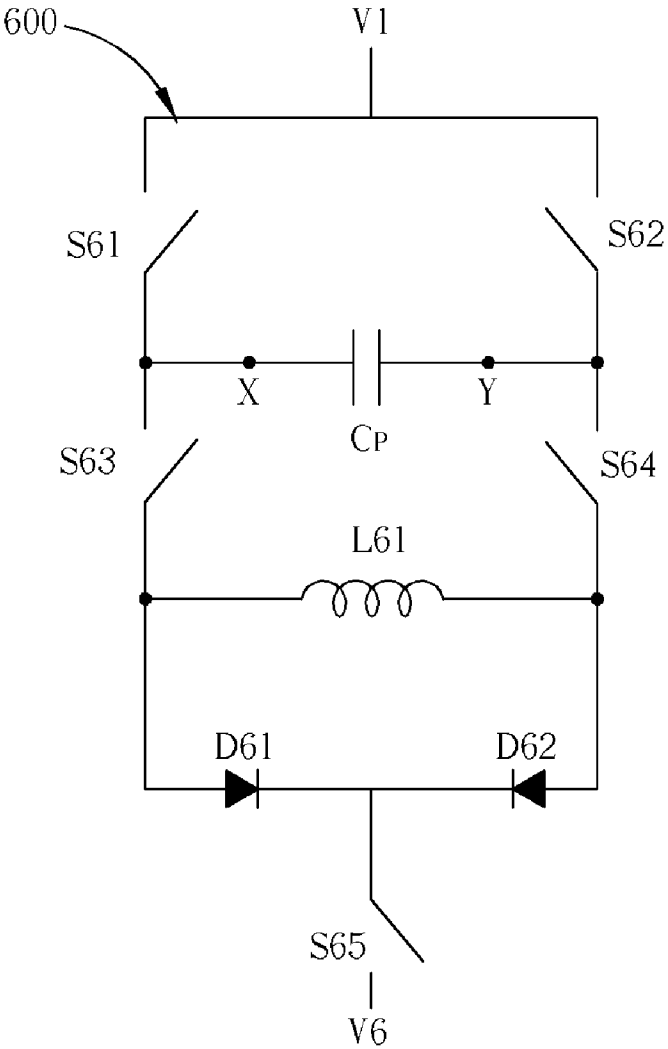
FIG. 6 is a circuit diagram of a plasma display panel driving circuit according to a third embodiment of the present invention.

Please refer to FIG. 6. FIG. 6 is a circuit diagram of a plasma display panel driving circuit 600 according to a third embodiment of the present invention. The driving circuit 600 comprises five switches S61, S62, S63, S64, and S65, two diodes D61 and D62, and an inductor L61, coupled to an equivalent panel capacitor $C_p$ of a plasma display panel. The driving circuit 600 is electrically connected to a voltage source V1, wherein the voltage potential output by voltage source V1 is greater than the voltage potential output by voltage source V6. The voltage V1 is a voltage, whereas the voltage V6 can be ground or a negative voltage.

The switch S61 is electrically connected between an X side of the panel capacitor $C_p$ and the voltage source V1, and the switch S62 is electrically connected between a Y side of the panel capacitor $C_p$ and the voltage source V1. The switch S63 is electrically connected between the X side of the panel capacitor $C_p$ and an anode of diode D61, and the switch S64 is electrically connected between the Y side of the panel capacitor $C_p$ and an anode of diode D62. Inductor L61 is electrically connected between the anode of diode D61 and the anode of diode D62. Switch S65 is electrically connected between voltage source V6 and the cathodes of diodes D61 and D62.

Figure 7:
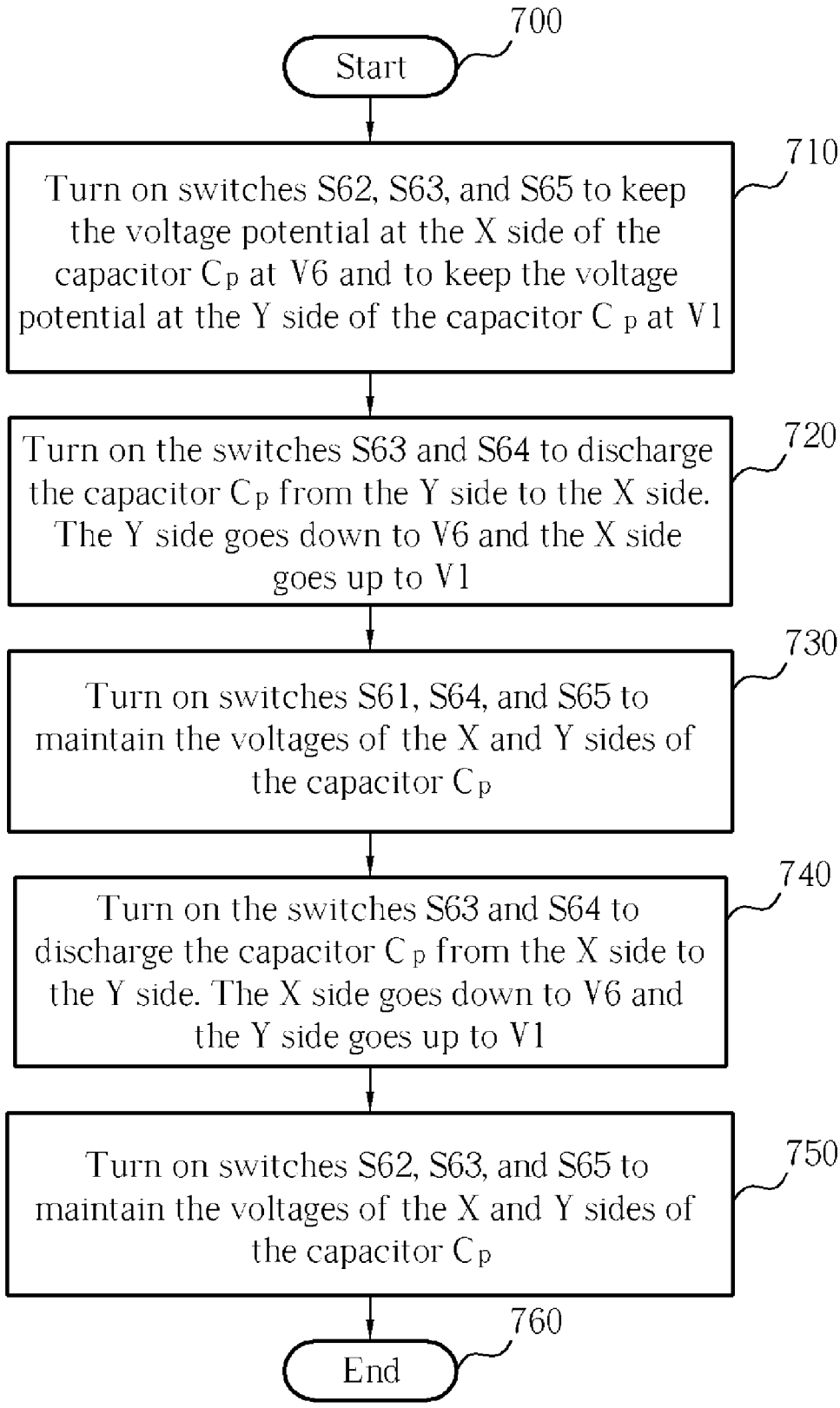
FIG. 7 is a flowchart illustrating the operation of the driving circuit of the third embodiment for creating a sustain waveform.

Please refer to FIG. 7, which illustrates the operation of the driving circuit 600 of the third embodiment for creating a sustain waveform. Steps contained in the flowchart will be explained as follows.

Step 700: Start.

Step 710: Keep the voltage potential at the X side of the panel capacitor $C_p$ at voltage source V6 by turning on the switches S63 and S65, where the current path is through S63, D61, and S65. Keep the voltage potential at the Y side of the panel capacitor $C_p$ at V1 by turning on the switch S62.

Step 720: Discharge the panel capacitor $C_p$ from the Y side to the X side by turning on the switches S63 and S64. The voltage potential at the X side of the panel capacitor $C_p$ goes up to V1 and the voltage potential at the Y side of the panel capacitor $C_p$ goes down to voltage source V6 accordingly, and the current path is through S64, L61, and S63.

Step 730: Keep the voltage potential at the X side of the panel capacitor $C_p$ at V1 by turning on the switch S61. Keep the voltage potential at the Y side of the panel capacitor $C_p$ at voltage source V6 by turning on the switches S64 and S65, where the current path is through S64, D62, and S65.

Step 740: Discharge the panel capacitor $C_p$ from the X side to the Y side by turning on the switches S63 and S64. The voltage potential at the X side of the panel capacitor $C_p$ goes down to voltage source V6 and the voltage potential at the Y side of the panel capacitor $C_p$ goes up to V1 accordingly, and the current path is through S63, L61, and S64.

Step 750: Keep the voltage potential at the X side of the panel capacitor $C_p$ at voltage source V6 by turning on the switches S63 and S65, where the current path is through S63, D61, and S65. Keep the voltage potential at the Y side of the panel capacitor $C_p$ at V1 by turning on the switch S62.

Step 760: End.

Figure 8:
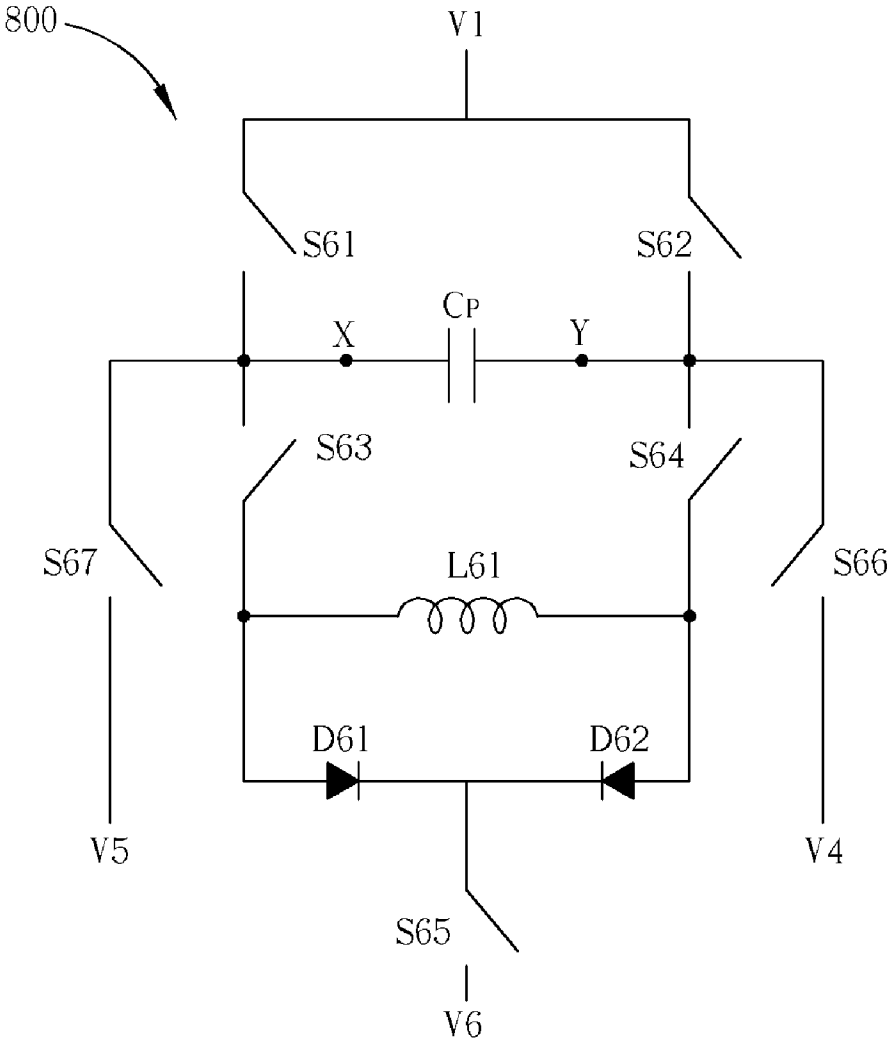
FIG. 8 is a circuit diagram of a plasma display panel driving circuit according to a fourth embodiment of the present invention.

Please refer to FIG. 8. FIG. 8 is a circuit diagram of a plasma display panel driving circuit 800 according to a fourth embodiment of the present invention. The driving circuit 800 is similar to the driving circuit 600 shown in FIG. 6, and also comprises the five switches S61, S62, S63, S64, and S65, two diodes D61 and D62, and the inductor L61 coupled to the panel capacitor $C_p$. The driving circuit 800 additionally includes switches S66 and S67 and voltage sources V4 and V5. Switch S66 is electrically connected between voltage source V4 and the Y side of the panel capacitor $C_p$. Switch S67 is electrically connected between voltage source V5 and the X side of the panel capacitor $C_p$. Voltage potentials output from voltage sources V4 and V5 are both negative, and are lower than the voltage potential output by voltage source V6.

In summary, the present invention provides embodiments of driving circuits that utilize fewer switches than the prior art driving circuit. Only five switches are required instead of six switches. Therefore, use of the present invention driving circuits reduces the space required on a semiconductor integrated circuit.

Those skilled in the art will readily observe that numerous modifications and alterations of the device and method may be made while retaining the teachings of the invention.

Accordingly, the above disclosure should be construed as limited only by the metes and bounds of the appended claims.

What is claimed is:

1. A plasma display panel driving circuit comprising:

a panel capacitor having a first side and a second side;

a first switch electrically connected between the first side of the panel capacitor and a first voltage;

a second switch electrically connected between the second side of the panel capacitor and the first voltage;

a third switch having a first end coupled to the first side of the panel capacitor and a second end;

a fourth switch having a first end coupled to the second side of the panel capacitor and a second end;

an inductor electrically connected between a second end of the third switch and a second end of the fourth switch;

a first diode having a first end coupled to the second end of the third switch and a second end;

a second diode having a first end coupled to the second end of the fourth switch and a second end coupled to a second end of the first diode; and a fifth switch electrically connected between a second voltage and the second end of the first diode.

2. The plasma display panel driving circuit of claim 1, wherein the first voltage is greater than the second voltage.

3. The plasma display panel driving circuit of claim 2, wherein the first ends of the first and second diodes are anodes and the second ends of the first and second diodes are cathodes.

4. The plasma display panel driving circuit of claim 2, wherein the first voltage is supplied by a voltage source and the second voltage is ground.

5. The plasma display panel driving circuit of claim 2, wherein the first voltage is supplied by a voltage source and the second voltage is supplied by a negative voltage source.

6. The plasma display panel driving circuit of claim 2, further comprising:

a sixth switch electrically connected between the first side of the panel capacitor and a third voltage; and a seventh switch electrically connected between the second side of the panel capacitor and a fourth voltage.

7. The plasma display panel driving circuit of claim 6, wherein the third and fourth voltages are less than the second voltage.

8. The plasma display panel driving circuit of claim 1, wherein the first voltage is less than the second voltage.

9. The plasma display panel driving circuit of claim 8, wherein the first ends of the first and second diodes are cathodes and the second ends of the first and second diodes are anodes.

10. The plasma display panel driving circuit of claim 8, wherein the first voltage is ground and the second voltage is supplied by a voltage source.

11. The plasma display panel driving circuit of claim 8, wherein the first voltage is supplied by a negative voltage source and the second voltage is supplied by a voltage source.

12. The plasma display panel driving circuit of claim 8, further comprising:

a sixth switch electrically connected between the first side of the panel capacitor and a third voltage; and a seventh switch electrically connected between the second side of the panel capacitor and a fourth voltage.

13. The plasma display panel driving circuit of claim 12, wherein the third and fourth voltages are greater than the second voltage.

14. The plasma display panel driving circuit of claim 1, wherein the first, second, third, fourth, and fifth switches are transistors.

15. The plasma display panel driving circuit of claim 14, wherein the transistors are P-type or N-type metal oxide semiconductor (MOS) transistors.

* * * * *